United States Patent [19]

Konars et al.

[11] 4,118,025

[45] Oct. 3, 1978

[54] DOCUMENT CONVEYING MEANS

[75] Inventors: Clement R. Konars, Glen Cove; Frank J. Schlipf, North Merrick; Emanuel Quinci, Dix Hills, all of N.Y.

[73] Assignee: Halm Instrument Co., Inc., Glen Head, N.Y.

[21] Appl. No.: 860,671

[22] Filed: Dec. 15, 1977

Related U.S. Application Data

[63] Continuation of Ser. No. 749,019, Dec. 9, 1976, abandoned.

[51] Int. Cl.[2] ..... B65H 5/02; B65H 29/12

[52] U.S. Cl. ..... 271/273; 271/271

[58] Field of Search ..... 271/272-274, 271/271; 226/172

[56] References Cited

U.S. PATENT DOCUMENTS

| | | | |
|---|---|---|---|
| 2,761,633 | 9/1956 | Sindzinski | 226/172 |
| 3,143,269 | 8/1964 | Van Eldik | 226/172 |

FOREIGN PATENT DOCUMENTS

| | | | |
|---|---|---|---|
| 872,726 | 2/1953 | Fed. Rep. of Germany | 271/274 |
| 7,382 of | 1905 | United Kingdom | 271/272 |
| 845,642 | 8/1960 | United Kingdom | 226/172 |

*Primary Examiner*—Robert W. Saifer
*Attorney, Agent, or Firm*—James P. Malone

[57] ABSTRACT

Document conveying apparatus without roller contact on the documents. An upper chain is mounted on upper sprockets and a lower chain is mounted on lower sprockets. A plurality of equally spaced friction grip members are mounted on the chains so that the upper and lower grip members contact each other in the absence of a document. The leading edges of the documents are gripped by the upper and lower sets of grip members and the documents are conveyed by the chains without roller contact on the documents.

1 Claim, 7 Drawing Figures

DOCUMENT CONVEYING MEANS

This is a continuation of application Ser. No. 749,019, filed Dec. 9, 1976 now abandoned.

This invention relates to document conveying means and more particularly to such means operating without roller contact on the documents.

Certain documents, such as multiple carbon forms with carbon papers interleaved cannot be conveyed with conventional squeeze rollers since the pressure of the rollers smudges the carbon onto the paper.

This invention solves this problem by conveying the documents with upper and lower chains having friction grips which grip the leading edges of the document. The invention is also useful for conveying thin or fragile documents.

Accordingly, a principal object of the invention is to provide new and improved document conveying means.

Another object of the invention is to provide new and improved document conveying means without roller contact on the documents.

Another object of the invention is to provide new and improved document and conveying means for carbon forms and thin and fragile documents.

Another object of the invention is to provide new and improved conveying means for conveying carbon forms without smudging carbon onto the documents.

Another object of the invention is to provide new and improved means for conveying documents without roller contact on the documents, comprising, a first pair of upper and lower driven sprockets, a second pair of upper and lower driven sprockets, an upper chain mounted on the upper sprockets, a lower chain mounted on the lower sprockets, a plurality of equally spaced friction grip members mounted on said chains so that the upper and lower grip members contact each other in the absence of a document, whereby the leading ends of the documents are gripped by the upper and lower sets of grip members and the documents are conveyed by the chains without roller contact on the documents.

These and other objects of the invention will be apparent from the following Specification and drawings of which:

Figure 1:
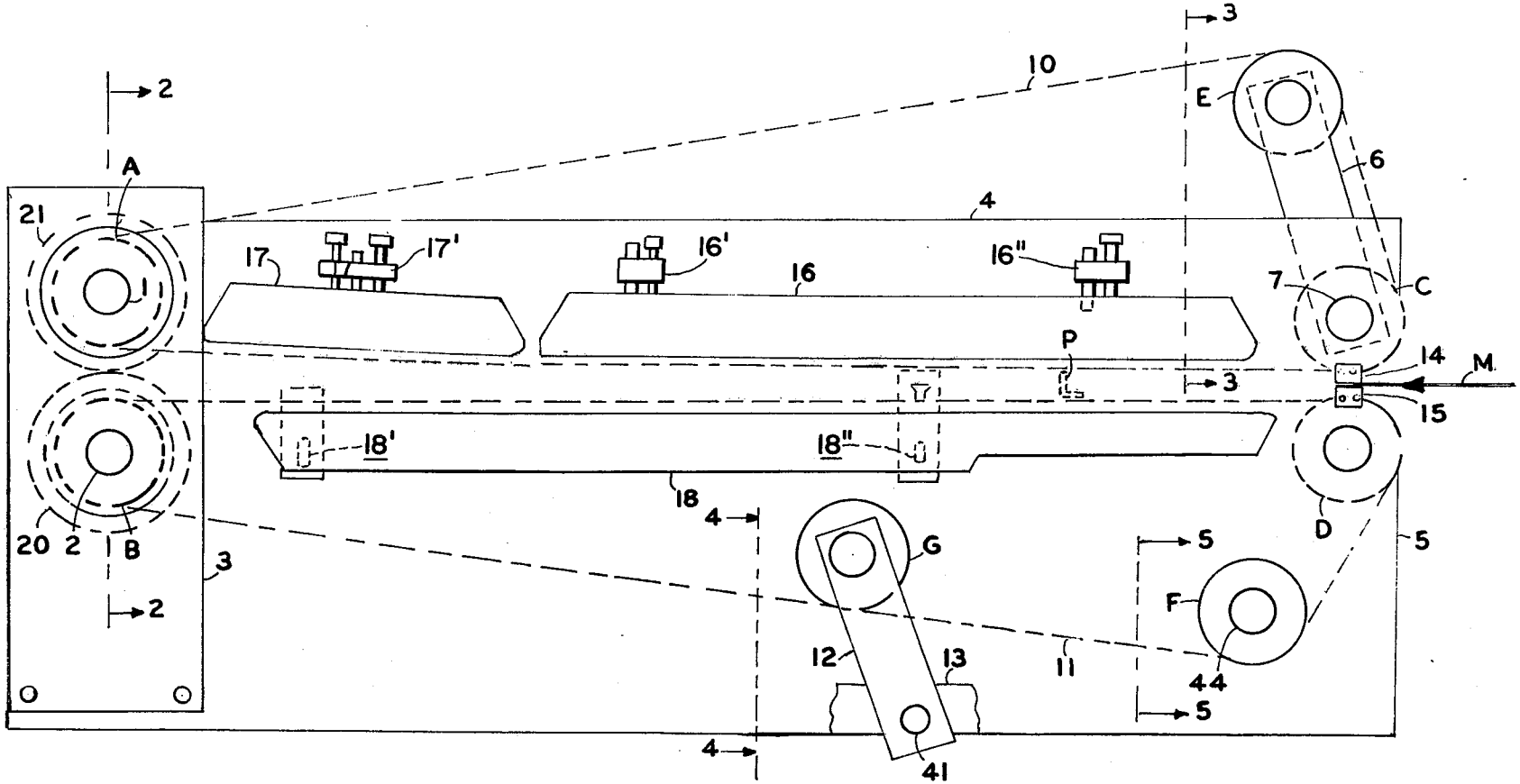
FIG. 1 is a side view of an embodiment of the invention.

Referring to FIG. 1, the invention comprises an upper pair of sprockets A and C and a lower pair of sprockets, B and D. Sprockets A and B are mounted on shafts 1 and 2, which are mounted in a mounting bracket 3. The sprocket C is mounted on a plate member 4, which is pivotally mounted on the shaft 1, so that the upper chain assembly consisting of the sprockets A and C, together with the tension adjusting sprocket E may be rotated upwardly about the axis of the shaft 1.

The sprocket D is mounted in a side frame member 5. The tension sprocket E is mounted on an arm 6, which is pivotally mounted on the shaft 7, of sprocket C, and the arm 6 is spring loaded to apply tension to the upper chain 10, which rides over the sprockets A, C and E. The lower chain 11, rides over the sprockets B, D and F, and tension adjusting sprocket G, which is mounted on the arm 12, which is pivotally mounted on a frame member 13. The arm 12 is spring loaded to apply tension to the lower chain 11.

A plurality of friction gripping member 14 and 15, are mounted on the lower and upper chains respectively. The upper chain rides underneath guide rails 16 and 17, and the lower chains rides on top of guide rail 18. The guide rails are adjustably mounted on the frame by adjustment means 18', 18", 16', 16" and 17' so as to provide proper spacing for good gripping by the gripping members. The guide rail 17, rises at an angle to release the document from the grip of the gripping members. At this point the document may be picked up by pushers P, which are mounted on another set of chains, (not shown). The shaft 44 is driven and it drives the lower chain. The upper chain is then driven by the gears 20 and 21. The lower gear 20 is driven by the lower chain 11, and the upper gear 21, drives the upper chain 10.

In operation, the documents M are fed to the apparatus so that the leading edge of the documents will be gripped between the gripping members 14 and 15. The documents are then conveyed to the left in FIG. 1 until the upper gripping member 15 comes in contact with the guide rail 17 which is slanted upwardly in direction of motion so that the upper gripping members will rise and release the documents. The document will then be picked up by the pushers P on a separate chain, (not shown) and fed as desired to a work station, such as printing rollers or a stacking device.

Figure 2:
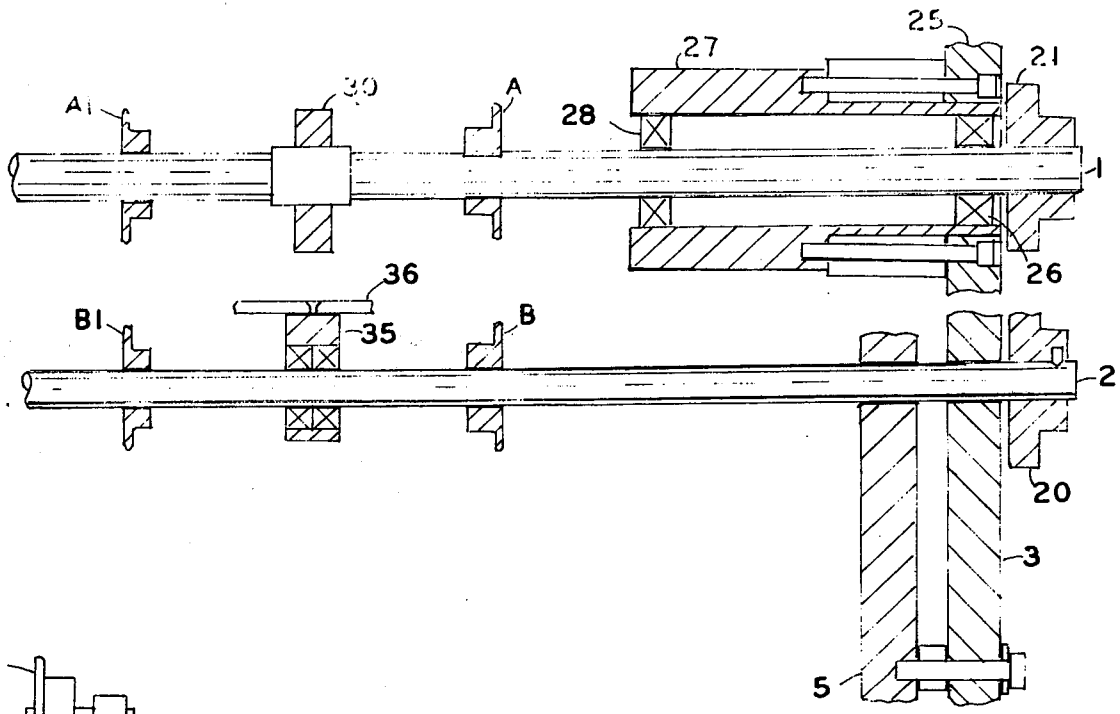
FIG. 2 is a detail view along the line 2—2 of FIG. 1.

FIG. 2 shows an end view of the mounting of the sprockets A and B. There are two upper sprockets, A and A1, mounted on the shaft 1. The shaft 1 is mounted on the frame 25 by means of the bearings 26 and reinforcing sleeve 27, which is supported at its other end by means of bearing 28. A center bar member 30 is provided for supporting the shaft 1. The sprockets B and B1 are mounted on the shaft 2, which is mounted on the bracket 3, by means of suitable bearings. The shafts 1 and 2 are geared together by means of the gears 20 and 21, so that the shaft 2 drives the shaft 1. Center bar 35, supports the center of the shaft 2. Center bar 35 is connected to the frame member 36.

Figure 3:
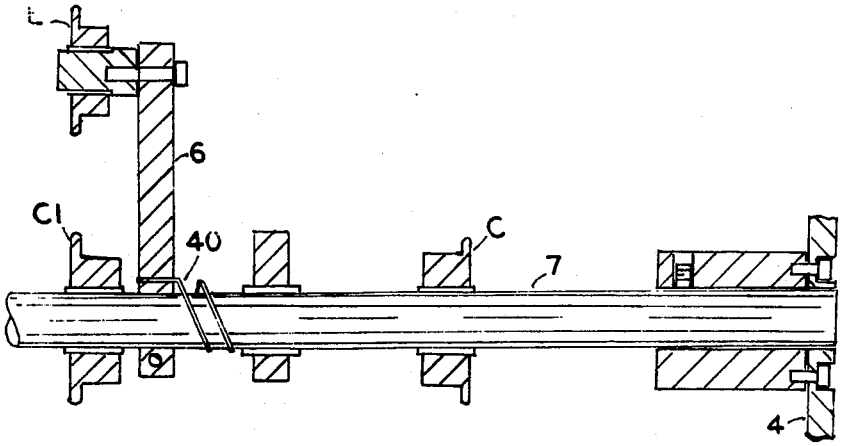
FIG. 3 is a detail view along the line 3—3 of FIG. 1.

FIG. 3 shows an end view of the shaft 7 assembly mounting the sprockets C and C1. The shaft 7 is also supported by the center bar 30. The shaft 7, is mounted in the side member 4, and the corresponding member on the other side. The shaft 7, does not rotate and the sprockets are mounted on it with suitable bearings. Also mounted on the shaft 7, is tension arm 6 and tension sprocket E. The arm 6 is spring loaded by means of the spring 40, to apply tension to the upper chain 10.

Figure 4:
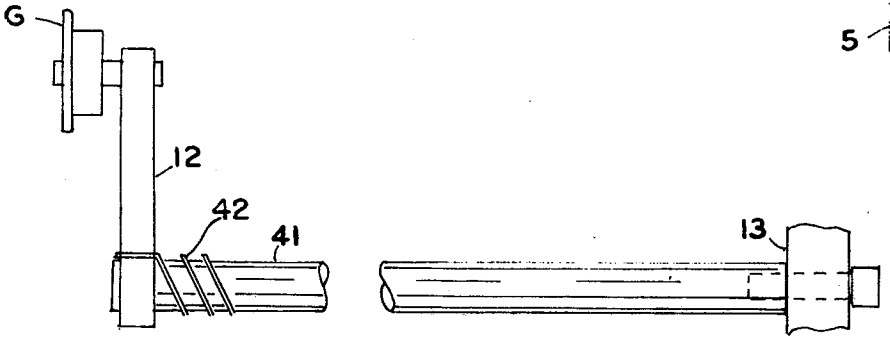
FIG. 4 is a detail view along the line 4—4 of FIG. 1.

FIG. 4 shows a side view of the lower tension sprocket G, which is mounted on the arm 12, which is rotatably mounted on the shaft 41 and spring loaded by the spring 42. The shaft 41, is fixedly mounted on the frame member 13.

Figure 5:
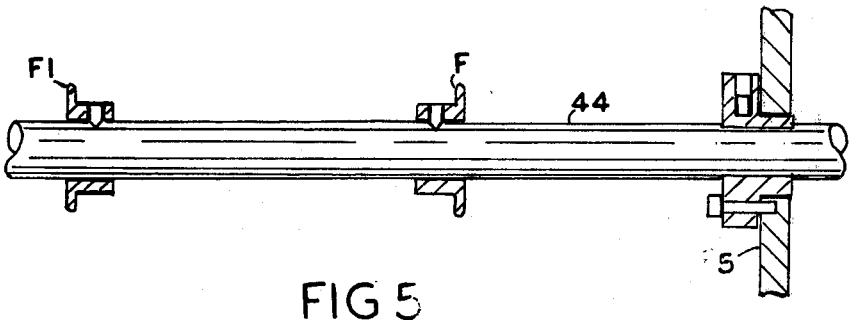
FIG. 5 is a detail view along the line 5—5 of FIG. 1.

FIG. 5 shows a detail view illustrating the mounting of the sprockets F and F1 on shaft 44. Shaft 44, is mounted on the frame member and is a driven shaft which supplies power to the conveyor system. Shaft 44, drives the lower chain and the lower chain drives the upper chain through gears 20 and 21. All of the other sprockets are idler sprockets.

Figure 6:
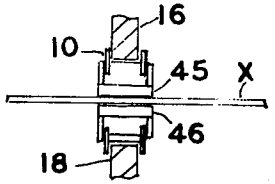
FIG. 6 and 6A are detail views illustrating the grippers.

FIG. 6 shows a detail view illustrating the operation of the gripping members 45 and 46. The gripping members are pads having friction gripping surfaces 45' and 46', which are equally spaced along the upper and lower chains. In FIG. 6, the upper gripping member 45, is mounted on the upper chain 10, and the lower gripping member 46, is mounted on the lower chain. The chains ride on the upper and lower rails, 16 and 18, the spacing of which is adjusted to provide a good gripping action on the document X. As shown in FIG. 1, the document is moved from right to left. As the upper chain 10, passes under the guide of the upper guide 17, the upper chain rises and releases the document. The release point may be chosen by adjusting member 17. The document will then by picked up by the pusher P, mounted on another set of chains, not shown, and carried in conventional manner to the desired location.

Figure 6A:
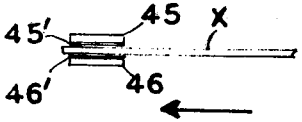

As shown in FIGS. 1 and 6A, the document M is fed to the gripping members 45 and 46 so that they grip the leading edge of the document M. The main body of the document is untouched by any external pressure such as by rollers. Therefore, multiple carbon forms can be conveyed without smudging the carbon and very thin and very fragile documents can be conveyed without crumpling or otherwise damaging them.

We claim:

1. Means for conveying documents without roller contact on the documents, comprising, a first pair of upper and lower driven sprockets, a second pair of upper and lower driven sprockets, an upper chain mounted on the upper sprockets, a lower chain mounted on the lower sprockets, a plurality of equally spaced friction grip members fixedly mounted on said chains so that the upper and lower grip members contact each other in the absence of a document, means to release the documents at points along the rails, comprising, upper rail means adjustably mounted on the frame to guide the upper chain and lower rail means adjustably mounted on the frame to directly and positively guide the lower chain and means to adjust the rails directly and positively to provide proper gripping action by the grippers, a separate upper rail means at the releasing end of the document travel being adjustably mounted so that said separate upper rail means is adjustably inclined away from the document path so as to release the document at a desired point, and pusher means adapted to pus the documents when released, whereby the leading ends of the documents are gripped by the upper and lower sets of grip members and the documents are conveyed by the chains without roller contact on the documents, to a desired point along the rails where the pusher means picks up the document.

* * * * *